US007156701B1

(12) United States Patent
Pennypacker et al.

(10) Patent No.: US 7,156,701 B1
(45) Date of Patent: Jan. 2, 2007

(54) HIGH-RELIABILITY DIMM CONNECTOR

(75) Inventors: Jeffrey George Pennypacker, Harrisburg, PA (US); Richard Nicholas Whyne, Camp Hill, PA (US); Daniel Robert Ringler, Elizabethville, PA (US); Attalee S. Taylor, Palmyra, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/263,305

(22) Filed: Oct. 31, 2005

(51) Int. Cl.
*H01R 24/00* (2006.01)

(52) U.S. Cl. ..... 439/637

(58) Field of Classification Search ..... 439/660, 439/631, 64, 637, 636, 638, 326
See application file for complete search history.

(56) References Cited

U.S. PATENT DOCUMENTS 4,737,120 A * 4/1988 Grabbe et al. ..... 439/326
4,869,672 A 9/1989 Andrews Jr.
5,399,105 A * 3/1995 Kaufman et al. ..... 439/609
5,697,800 A * 12/1997 Aramizu ..... 439/259
6,176,723 B1 * 1/2001 Sakata et al. ..... 439/326
6,340,307 B1 * 1/2002 Sugita ..... 439/326
6,478,603 B1 * 11/2002 Wu ..... 439/378
6,746,257 B1 6/2004 Billman
2004/0259405 A1 * 12/2004 Lynch et al. ..... 439/326

* cited by examiner

*Primary Examiner*—Tulsidas C. Patel
*Assistant Examiner*—Harshad C Patel

(57) ABSTRACT

A socket connector for connecting a card edge module to a circuit board includes a base extending along a longitudinal axis between opposed ends. The base includes a mounting face configured to be received on the circuit board. Support towers are integrally formed with the base and located at the opposed ends of the base. The support towers extend upward from the base away from the mounting face. Each of the base and the towers includes open sided mating surfaces that collectively define a mating plane. The open sided mating surfaces are configured to receive the card edge module from a lateral direction with respect to the mating plane when the card edge module is loaded into the connector. Electrical contacts are held in the base. The contacts have mating ends extending laterally from the open-sided mating surface of the base. The contacts have mounting ends that extend from the mounting face.

20 Claims, 3 Drawing Sheets

HIGH-RELIABILITY DIMM CONNECTOR

BACKGROUND OF THE INVENTION

The invention relates generally to sockets for retaining card edge memory modules and, more particularly, to a high reliability socket for memory modules.

Computers and servers may use numerous types of electronic modules, such as processor and memory modules (e.g. Dynamic Random Access Memory (DRAM), Synchronous Dynamic Random Access Memory (SDRAM), or Extended Data Out Random Access Memory (EDO RAM), an the like). The modules are produced in a number of formats such as, for example, Single In-line Memory Modules (SIMM's), or the newer Dual In-line Memory Modules (DIMM's) and Fully Buffered DIMM's.

Typically, the modules are installed in one or more multi-pin sockets mounted on a system board or motherboard. Each module has a card edge that provides an interface generally between two rows of contacts in the socket. Conventionally, the card edge interface is a separable card edge interface. These card edge interfaces, however, are generally not high reliability interfaces and therefore do not meet requirements for some high end server applications. For example, card edge interfaces may fail when subjected to shock and vibration which may occur, for instance, during shipping, loading and unloading. End wall towers and latching mechanisms on the sockets are particularly susceptible to failure from vibration. Further, high insertion forces and mating forces can deflect the card sufficiently to damage components on the card.

One commonly used approach for increasing reliability is to directly attach the module via an inseparable interface. This is sometimes done when it is desirable that the end user not be able to remove processors or memory modules from the system so that problems that might arise from reconfiguration of the system do not occur. The provision of a high reliability interface that meets the requirements for high end systems and applications remains difficult.

BRIEF DESCRIPTION OF THE INVENTION

In one aspect, a socket connector for connecting a card edge module to a circuit board is provided. The socket connector includes a base extending along a longitudinal axis between opposed ends. The base includes a mounting face configured to be received on the circuit board. Support towers are integrally formed with the base and located at the opposite ends of the base. The support towers extend upward from the base away from the mounting face. Each of the base and the towers includes open sided mating surfaces that collectively define a mating plane. The open sided mating surfaces are configured to receive the card edge module from a lateral direction with respect to the mating plane when the card edge module is loaded into the connector. Electrical contacts are held in the base. The contacts have mating ends extending laterally from the open-sided mating surface of the base. The contacts have mounting ends that extend from the mounting face.

Optionally, the open-sided mating surface of the base is defined by an alignment plate having a vertical wall joined with a bottom ledge. The bottom ledge is configured to receive an edge of the card edge module. The base includes a recess and an alignment plate received in the recess. The alignment plate includes a vertical wall. The vertical wall includes the open sided mating surface of the base. The base includes a plurality of transverse slots formed along the longitudinal axis. The slots receive a portion of the electrical contacts. The contacts are arranged in pairs in first and second contact rows. The contacts of each pair are substantially equal in length such that the socket connector is substantially skewless.

In another aspect, a card edge module assembly is provided that includes a card edge module including a substrate having a mating edge and a plurality of electrical traces. Each electrical trace terminates at a respective contact aperture at the mating edge. A socket connector includes a base extending along a longitudinal axis between opposed ends. The base includes a mounting face configured to be received on the circuit board. Support towers are integrally formed with the base and located at the opposed ends of the base. The support towers extend upward from the base away from the mounting face. Each of the base and the towers include open sided mating surfaces that collectively define a mating plane. The open sided mating surfaces are configured to receive the card edge module from a lateral direction with respect to the mating plane when the card edge module is loaded into the connector.

DETAILED DESCRIPTION OF THE INVENTION

Figure 1:
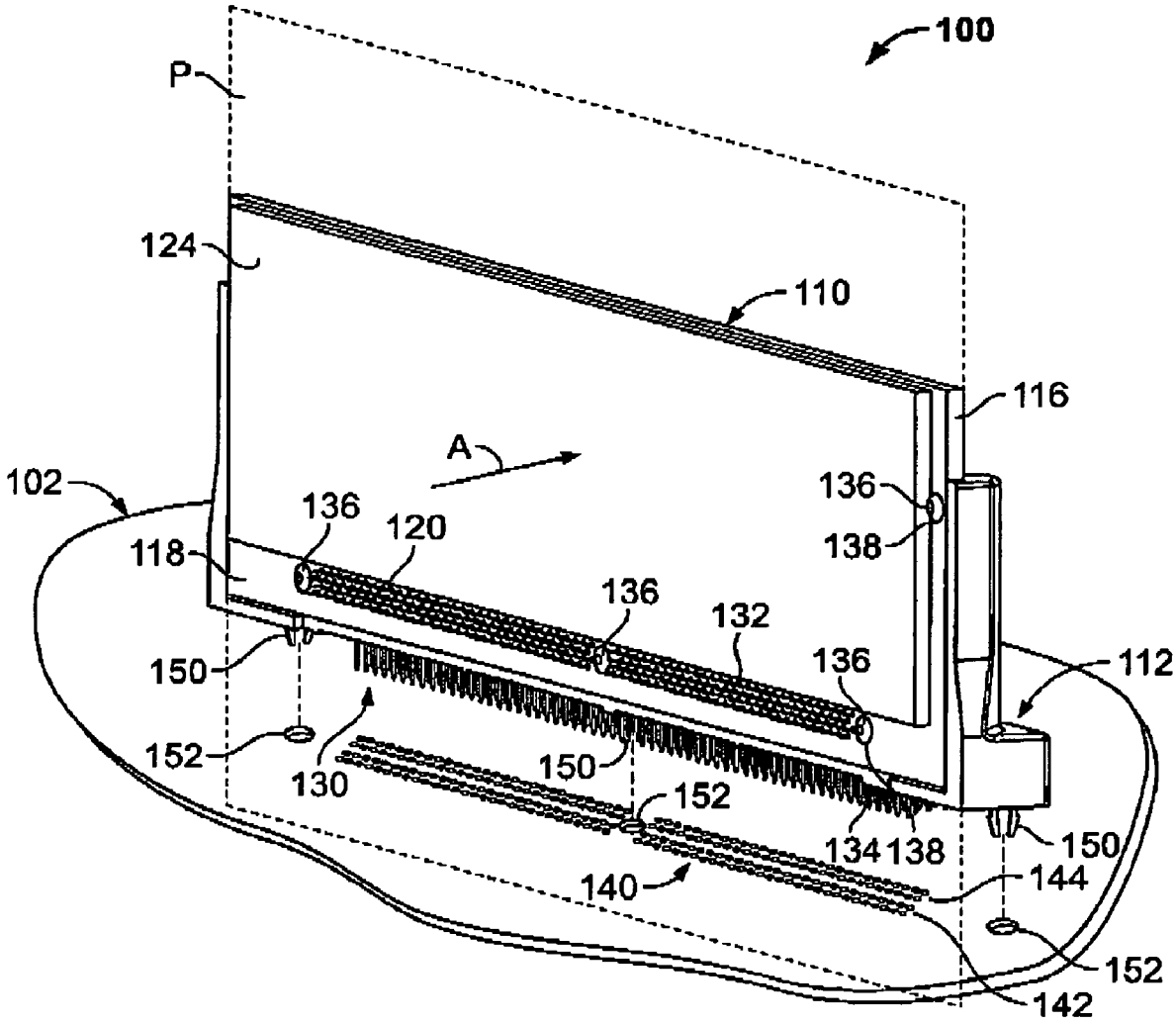
FIG. 1 is a perspective view of an exemplary card edge module assembly formed in accordance with an exemplary embodiment of the present invention.

FIG. 1 illustrates an exemplary card edge module assembly 100 that is configured to be mounted on a circuit board 102. The card edge module assembly 100 includes an electronic module 110 that is loaded into a socket connector 112. The electronic module 110, in one embodiment, may be a Dual In-Line Memory Module (DIMM); however, no limitation is intended thereby. Alternatively, it is contemplated that the electronic module 110 may take other forms such as Single In-Line Memory Modules (SIMM) and other edge mounted memory modules. The card edge module assembly 100 allows circuit boards, such as motherboards used in computer equipment, to be made in somewhat standard configurations that can later be customized when memory is added.

The module 110 includes a substantially planar substrate 116 that has a mating edge 118 and a plurality of electrical traces, each of which terminates at a respective plated contact aperture 120 in the mating edge 118. The substrate 116 may also include surface mounted components generally represented at 124. The socket connector 112 defines a mating plane or retention plane P for the electronic module 110. The electronic module 110 is loaded into the socket connector 112 from a lateral direction as indicated by the arrow A which, in one embodiment, is substantially perpendicular to the plane P.

The socket connector 112 holds electrical contacts 130 that have mating ends 132 and mounting ends 134. Mating ends 132 extend laterally from the socket connector 112 in a direction parallel to the arrow A. The contact mating ends 132 are received in the contact apertures 120 in the substrate 116 when the electronic module 110 is loaded into the socket connector 112. In an exemplary embodiment, the contact mating ends 132 are soldered in contact apertures 120. In this manner, a separable interface is eliminated and the reliability of the card edge module assembly 100 is enhanced. The socket connector 112 also includes staking posts 136 that are received in staking post apertures 138 in the substrate 116. The staking posts 136 are ultrasonically welded to further retain the electronic module 110 in the socket connector 112 in a non-separable manner.

The mounting ends 134 of the electrical contacts 130 are configured to be received in contact apertures 140 in the circuit board 102. The contact apertures 140 include pairs of contacts arranged in first and second rows 142 and 144, respectively. The contact mounting ends 134 are arranged in a complementary pattern that such that the mounting ends 134 are received in the apertures 140 when the card edge module assembly 100 is mounted on the circuit board 102. Board locks 150 are provided on the connector 112 that are received in plated through holes 152 in the circuit board 102 to lock the card edge module assembly 100 to the circuit board 102. In an exemplary embodiment, the contact mounting ends 134 and the broad locks 150 are soldered to the circuit board 102.

Figure 2:
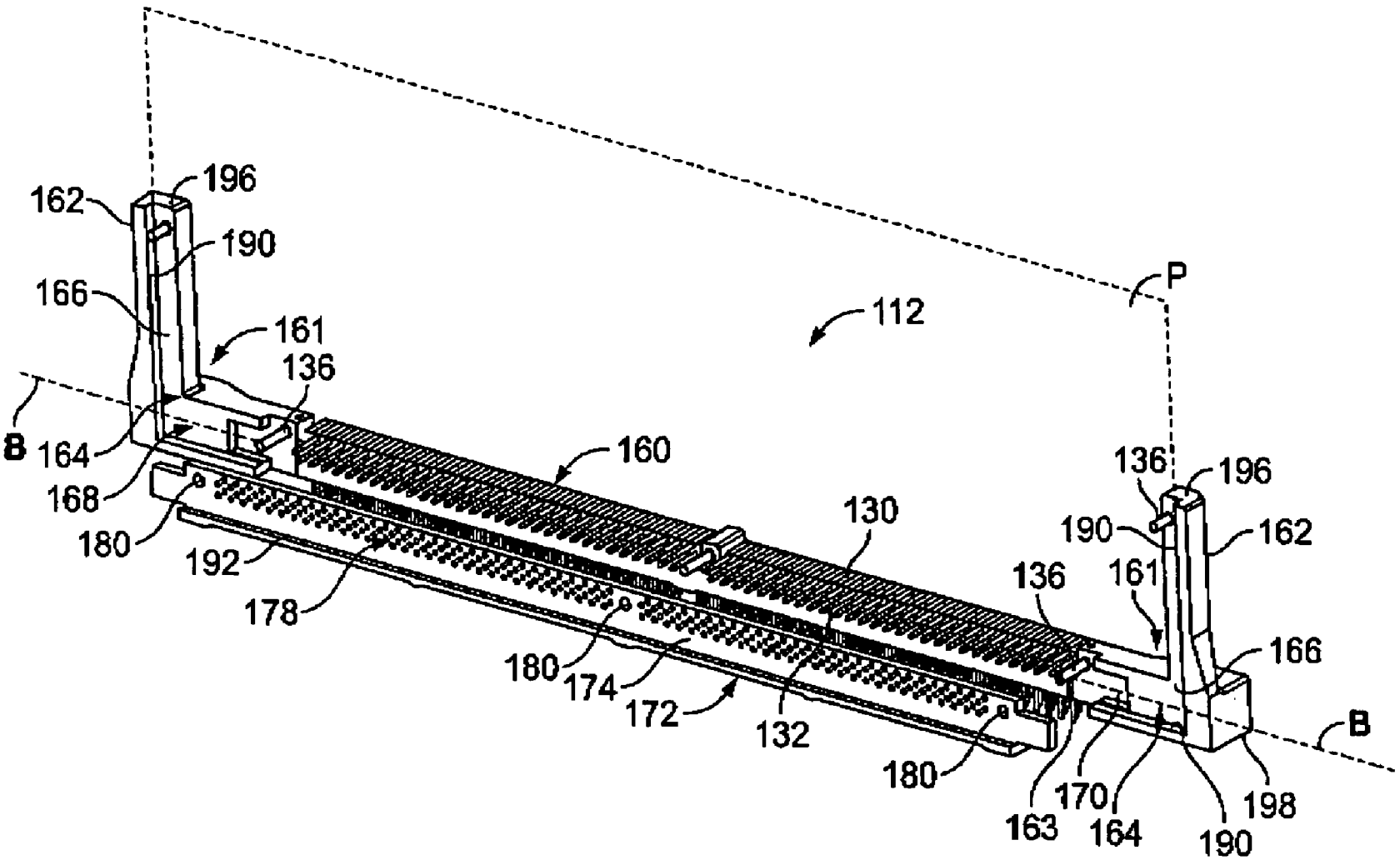
FIG. 2 is a perspective view of the socket connector shown in FIG. 1.

FIG. 2 a perspective view of the socket connector 112. The socket connector 112 includes a base 160 that extends along a longitudinal axis B between opposed ends 161 and a mounting face 163 that is configured to be received on the circuit board 102 (FIG. 1). Supporting towers 162 are integrally formed with the base 160 and are located at the opposed ends 161 of the base 160. The supporting towers 162 extend upward from the base 160 away from the mounting face 163 of the base 160. The supporting towers 162 include a recessed pocket 164 that includes open sided mating surfaces 166 that engage the electronic module 110 (FIG. 1) when the electronic module is loaded into the socket connector 112. The mating plane P is perpendicular to a mating face 168 of the socket connector 112. The base 160 includes a recess 170 that receives an alignment plate 172. The alignment plate 172 includes a vertical wall 174 that is coextensive with the mating surfaces 166. More specifically, the vertical wall 174 forms an open sided mating surface on the base 160 that cooperates with the open sided mating surfaces 166 to define the mating plane P when the alignment plate 172 is installed in the recess 170. The open sided mating surfaces 166 and the vertical wall 174 also cooperates to form the mating face 168. The alignment plate 172 includes contact apertures 178 that receive the contact mating ends 132 and staking post apertures 180 that receive the staking posts 136. The recesses 164 in the supporting towers 162 include perimeter edges 190 that locate the electronic module 110 in the socket connector 112. The alignment plate 172 includes a bottom ledge 192 that is joined to the vertical wall 174. The bottom ledge 192 cooperates with the perimeter edges 190 to locate the electronic module 110 in the socket connector 112. Further, the bottom ledge is configured to receive an edge of the electronic module 110. The alignment plate 172 facilitates keeping the base 160 flat and true so that the contact mating ends 132 are properly positioned to register with the contact apertures 120 in the electronic module 110.

One of the staking posts 136 is provided on each supporting tower 162 proximate an upper end 196. A board lock 150 (FIG. 1) is positioned on a mounting face 198 of each supporting tower 162 to anchor the supporting towers 162 to the circuit board 102. The supporting towers 162 are compliant towers that may flex with the electronic module 110 to provide both support and damping to render the card edge module assembly 100 and the solder joints less susceptible to damage from shock and vibration.

Figure 3:
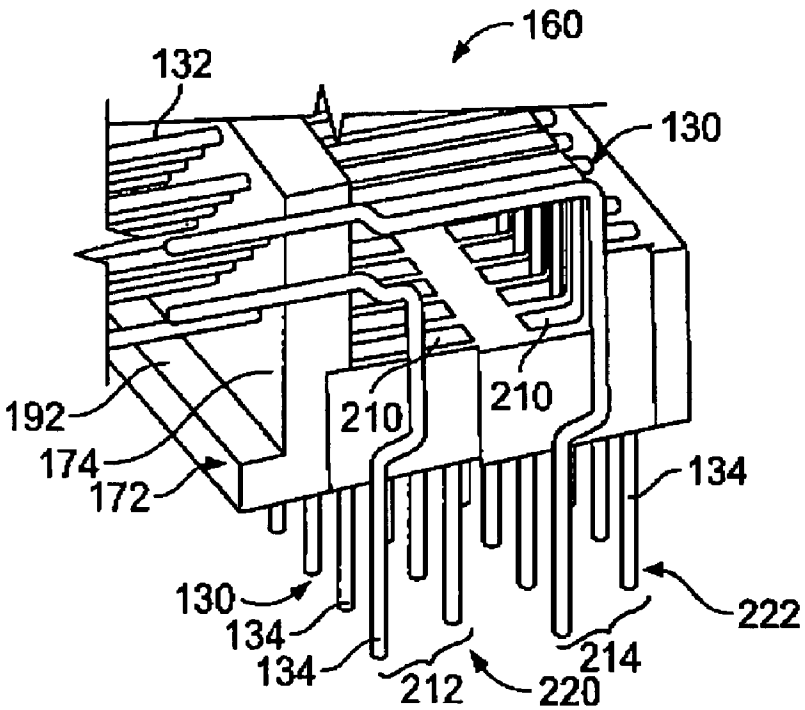
FIG. 3 is a detail fragmentary view of an exemplary connector base.

FIG. 3 is a detail fragmentary view of a portion of the base 160. The electrical contacts 130 are held in the base 160. The base 160 includes slots 210 that receive a portion of the contacts between the mating ends 132 and the mounting ends 134. The alignment plate 172 holds the contact mating ends 132 in position to mate with the electronic module 110. The contacts are arranged in pairs 212 and 214 in a first contact row 220 and a second contact row 222, respectively.

Figure 4:
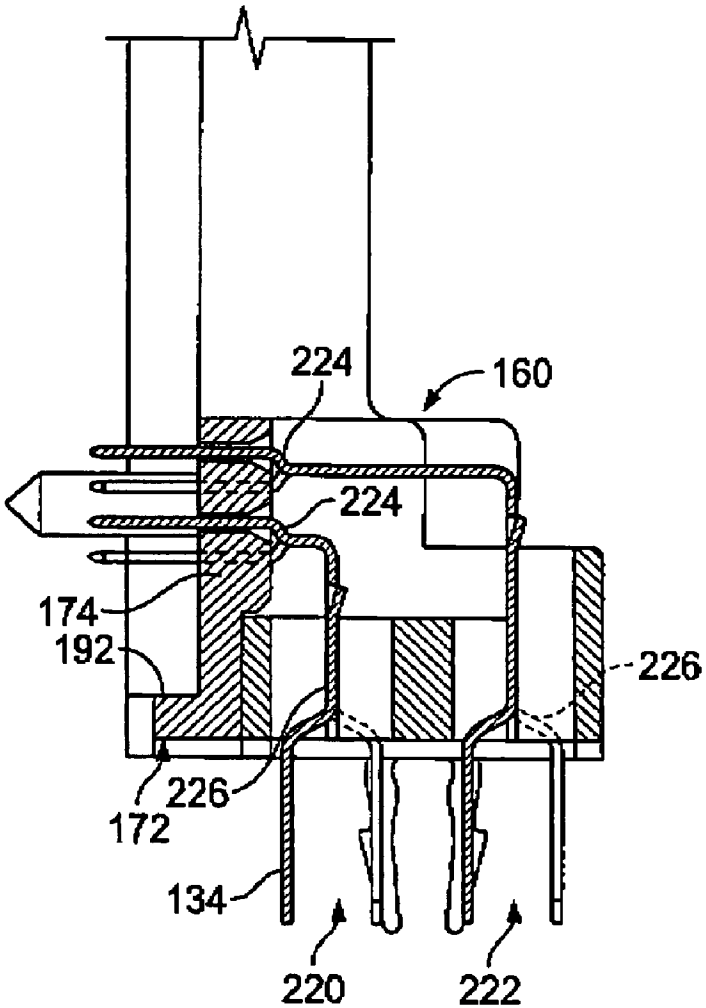
FIG. 4 is a fragmentary cross sectional view of an exemplary connector base.

FIG. 4 is a fragmentary cross sectional view of the base 160 illustrating the geometry of the contacts 130. Portions of the contacts 130 not captured on the cross section are shown in phantom. In one embodiment, the contact pairs 212 and 214 are differential pairs. Within a contact pair 212 and 214 each contact has an overall length that is substantially the same. Each contact in a contact pair 212, 214 is provided with corresponding opposite bends as indicated at 224 and 226 to equalize contact lengths. Thus, the socket connector 112 is without skew.

The embodiments thus described provide a high reliability module socket having no separable interface. Attachment of the module to the socket is through-hole soldered connections. Thus, clamping forces required in contact pads in card edge connector applications are eliminated. The module is loaded into the socket in a horizontal direction which eliminates the need for downward insertion forces which minimizes the risk of damaging components on the module. The socket includes extended towers at the ends of the module along with staking posts that provide improved reliability when subjected to shock and vibration. The socket is compatible with fully buffered electrical requirements. Optionally, the socket may be used with card type modules other than memory modules. For example, the socket may receive a daughter card or mother board containing a variety of circuit components, each of which is encompassed within the term module as used herein.

While the invention has been described in terms of various specific embodiments, those skilled in the art will recognize that the invention can be practiced with modification within the spirit and scope of the claims.

What is claimed is:

1. A socket connector for connecting a card edge module to a circuit board, said socket connector comprising:

a base extending along a longitudinal axis between opposed ends, the base including a mounting face configured to be received on the circuit board;

support towers integrally formed with the base and located at the opposed ends of the base, the support towers extending upward from the base away from the mounting face, each of said base and said towers including open sided mating surfaces that collectively define a mating plane, the open sided mating surfaces being configured to receive the card edge module from a lateral direction with respect to said mating plane when the card edge module is loaded into the connector, the mating plane having an entirely open side such that the open sided mating surface of the base is entirely exposed laterally in a direction extending perpendicular from the mating plane; and electrical contacts held in said base, said contacts having mating ends extending laterally from, and being exposed at, the open-sided mating surface of the base, the contacts having mounting ends extending from the mounting face.

2. The socket connector of claim 1, wherein the open-sided mating surface of the base is defined by an alignment plate having a vertical wall joined with a bottom ledge, the bottom ledge being configured to receive an edge of the card edge module when the card edge module is loaded into a direction perpendicular to the mating plane.

3. The socket connector of claim 1, wherein said base includes a recess and an alignment plate received in said recess, said alignment plate including a vertical wall, said vertical wall comprising said open sided mating surface of said base.

4. The socket connector of claim 1, wherein said base includes a plurality of transverse slots formed along said longitudinal axis, said slots receiving a portion of said electrical contacts.

5. The socket connector of claim 1, wherein said contacts are arranged in pairs in first and second contact rows, the contacts of each said pairs being substantially equal in length such that the socket connector is substantially skewless.

6. The socket connector of claim 1, wherein said contact mating ends comprise pin contacts extending laterally from said base.

7. The socket connector of claim 1, wherein said base and said towers include staking posts configured to be received in staking post apertures in the card edge module to retain the card edge module in the connector.

8. The socket connector of claim 1, wherein said towers includes board locks configured to lock the connector to the circuit board.

9. The socket connector of claim 1, wherein said contacts are arranged in pairs in first and second contact rows.

10. A card edge module assembly comprising:

a card edge module comprising a substrate having a mating edge and a plurality of electrical traces, each said electrical trace terminating at a respective contact aperture at said mating edge; and a socket connector comprising:

a base extending along a longitudinal axis between opposed ends, the base including a mounting face configured to be received on the circuit board;

support towers are integrally formed with the base and located at the opposed ends of the base, the support towers extending upward from the base away from the mounting face, each of said base and said towers including open sided mating surfaces that collectively define an exposed mating plane, the open sided mating surfaces being configured to receive the card edge module from a lateral direction with respect to said mating plane when the card edge module is loaded into the connector, the mating plane having an entirely open side such that the open sided mating surface of the base is entirely exposed laterally in a direction extending perpendicular from the mating plane.

11. The module assembly of claim 10, wherein said base includes contacts having mating ends and mounting ends, said mating ends comprising pin contacts extending laterally from said base, said pin contacts being received in said contact apertures with a soldered connection.

12. The module assembly of claim 10, wherein said base and said towers include staking posts and said substrate includes staking post apertures that receive said staking posts when said card edge module is loaded into said connector.

13. The module assembly of claim 10, wherein said base includes a recess and an alignment plate received in said recess, said alignment plate including a vertical wall, said vertical wall comprising said open sided mating surface of said base.

14. A card edge module assembly comprising:

a card edge module comprising a substrate having a mating edge and a plurality of electrical traces, each said electrical trace terminating at a respective contact aperture at said mating edge; and a socket connector comprising:

a base extending along a longitudinal axis between opposed ends, the base including a mounting face configured to be received on the circuit board;

support towers integrally formed with the base and located at the opposed ends of the base, the support towers extending upward from the base away from the mounting face, each of said base and said towers including open sided mating surfaces that collectively define an exposed mating plane, the open sided mating surfaces being configured to receive the card edge module from a lateral direction with respect to said mating plane when the card edge module is loaded into the connector, wherein said open sided mating surface is defined by an alignment plate having a vertical wall joined with a bottom ledge that receives an edge of said card edge module, said bottom ledge being entirely exposed through said open sided mating surface.

15. The module assembly of claim 10, wherein said base includes contacts arranged in pairs in first and second contact rows, the contacts of each said pairs being substantially equal in length such that the socket connector is substantially skewless.

16. The module assembly of claim 10, wherein said card edge module comprises a memory module.

17. A socket connector for connecting a card edge module to a circuit board, said socket connector comprising:

a base extending along a longitudinal axis between opposed ends, the base including a mounting face configured to be received on the circuit board;

support towers integrally formed with the base and located at the opposed ends of the base, the support towers extending upward from the base away from the mounting face, each of said base and said towers including open sided mating surfaces that collectively define a mating plane, the open sided mating surfaces being configured to receive the card edge module from a lateral direction with respect to said mating plane when the card edge module is loaded into the connector, wherein the open-sided mating surface of the base is defined by an alignment plate having a vertical wall extending up from a bottom ledge, the vertical wall being entirely exposed to the open-sided mating surface down to the bottom ledge; and electrical contacts held in said base, said contacts having mating ends extending laterally from, and being exposed at, the open-sided mating surface of the base, the contacts having mounting ends extending from the mounting face.

18. A card edge module assembly comprising:

a card edge module comprising a substrate having a mating edge and a plurality of electrical traces, each said electrical trace terminating at a respective contact aperture at said mating edge; and a socket connector comprising:

a base extending along a longitudinal axis between opposed ends, the base including a mounting face configured to be received on the circuit board;

support towers integrally formed with the base and located at the opposed ends of the base, the support towers extending upward from the base away from the mounting face, each of said base and said towers including open sided mating surfaces that collectively define an exposed mating plane, the open sided mating surfaces being configured to receive for card edge module from a lateral direction with respect to said mating plane when the card edge module is loaded into the connector, wherein the open-sided mating surface of the base is defined by an alignment plate having a vertical wall extending up from a bottom ledge, the vertical wall being entirely exposed to the open-sided mating surface down to the bottom ledge.

19. The socket connector of claim 1, wherein said base includes a bottom ledge configured to engage an edge of the card edge module, said bottom ledge being entirely exposed laterally along the open sided mating surface.

20. The socket connector of claim 10, wherein said base includes a bottom ledge configured to engage an edge of the card edge module, said bottom ledge being entirely exposed laterally along the open sided mating surface.

* * * * *